US008910441B1

(12) United States Patent
Hunter et al.

(10) Patent No.: US 8,910,441 B1
(45) Date of Patent: Dec. 16, 2014

(54) CLADDING ATTACHMENT SYSTEM TO ENABLE AN EXTERIOR CONTINUOUS INSULATION BARRIER

(71) Applicants: Kenneth Hunter, Littleton, CO (US); Wolfgang Andreas Haussler, Ors.-Nenzingen (DE)

(72) Inventors: Kenneth Hunter, Littleton, CO (US); Wolfgang Andreas Haussler, Ors.-Nenzingen (DE)

( * ) Notice: Subject to any disclaimer, the term of this patent is extended or adjusted under 35 U.S.C. 154(b) by 0 days.

(21) Appl. No.: 14/092,840

(22) Filed: Nov. 27, 2013

(51) Int. Cl.

| | |
|---|---|
| ***E04C 2/34*** | (2006.01) |
| ***E04F 13/24*** | (2006.01) |
| ***E04F 13/08*** | (2006.01) |
| *E04B 2/30* | (2006.01) |
| *E04B 2/28* | (2006.01) |

(52) U.S. Cl.
CPC ..... *E04F 13/24* (2013.01); *E04F 13/08* (2013.01); *E04B 2/30* (2013.01); *E04B 2/28* (2013.01)
USPC ..... 52/475.1; 52/474; 52/479; 52/489.1; 52/489.2

(58) Field of Classification Search
CPC ..... E04B 2/02; E04B 2/28; E04B 2/30; E04B 1/70; E04C 2/34
USPC ..... 52/479, 481.1, 481.2, 483.1, 489.1, 52/489.2, 235, 474, 475.1
See application file for complete search history.

(56) References Cited

U.S. PATENT DOCUMENTS

| | | | | | |
|---|---|---|---|---|---|
| 1,968,615 | A * | 7/1934 | Nygaard | 52/479 |
| 2,222,576 | A * | 11/1940 | Schauble | 52/479 |
| 2,245,611 | A * | 6/1941 | Schultz | 52/376 |
| 3,214,875 | A * | 11/1965 | Slowinski et al. | 52/364 |
| 3,611,664 | A * | 10/1971 | Barbera | 52/481.1 |
| 4,021,990 | A * | 5/1977 | Schwalberg | 52/479 |
| 4,028,859 | A * | 6/1977 | Bellagamba | 52/393 |
| 4,110,948 | A * | 9/1978 | Maier, Jr. | 52/402 |
| 4,112,647 | A * | 9/1978 | Scheid | 52/481.2 |
| 4,121,391 | A * | 10/1978 | Schroeder | 52/235 |
| 4,163,350 | A * | 8/1979 | Doguchi et al. | 52/483.1 |
| 4,223,505 | A * | 9/1980 | Krebel et al. | 52/509 |
| 4,275,541 | A * | 6/1981 | Orals et al. | 52/481.1 |
| 4,621,963 | A * | 11/1986 | Reinwall | 411/369 |
| 4,719,730 | A * | 1/1988 | Winkowski | 52/238.1 |
| 4,774,791 | A * | 10/1988 | Kafarowski | 52/235 |
| 5,224,322 | A * | 7/1993 | van den Toorn | 52/765 |
| 5,505,029 | A * | 4/1996 | Lind | 52/235 |
| 5,557,898 | A * | 9/1996 | Dixon | 52/410 |
| 5,870,870 | A * | 2/1999 | Utzman | 52/483.1 |
| 8,191,327 | B2 * | 6/2012 | Griffiths et al. | 52/506.08 |
| 8,316,599 | B2 * | 11/2012 | Griffiths | 52/235 |
| 8,683,765 | B2 * | 4/2014 | Hillers | 52/309.4 |
| 2010/0229484 | A1 * | 9/2010 | Carolan et al. | 52/302.1 |
| 2012/0137610 | A1 * | 6/2012 | Knight et al. | 52/309.1 |
| 2013/0205698 | A1 * | 8/2013 | Todd et al. | 52/302.1 |

* cited by examiner

*Primary Examiner* — Phi A
(74) *Attorney, Agent, or Firm* — Quinn & Quinn, P.C.; William J. Quinn; Cornelius P. Quinn

(57) ABSTRACT

An attachment system for a ventilated rain screen cladding system that is ASHRAE 90.1 compliant eliminating thermal breaks where anti-crush brackets have threaded horizontal apertures which engage threaded horizontal fasteners that are secured by threads into the wall studs and where anti-crush brackets have threaded diagonal apertures which engage threaded diagonal fasteners that are secured by threads into wall studs.

6 Claims, 5 Drawing Sheets

CLADDING ATTACHMENT SYSTEM TO ENABLE AN EXTERIOR CONTINUOUS INSULATION BARRIER

CROSS REFERENCE TO RELATED APPLICATION

This application claims the benefit of U.S. provisional patent application Ser. No. 61/836,629, filed Jun. 18, 2013, entitled Metal Attachment System for a Ventilated Rain Screen Cladding System, which is incorporated herein by reference.

FIELD OF THE INVENTION

The present invention relates to methods of attaching ventilated rain screen cladding systems where exterior insulation panels are present minimizing thermal breaks to meet or exceed ASHRAE 90.1 standards; and more particularly, the present invention is directed toward a metal attachment systems for ventilated rain screen systems that exceeds ASHRE 90.1 standards, are readily installed and prevents exterior foam insulation compression.

BACKGROUND OF THE INVENTION

Ventilated rain screen cladding systems are known in the prior art. Typically in a ventilated rain screen cladding system insulation is affixed exterior to the structural wall and a framework is attached exterior to the structural wall, often having brackets that traverse the exterior insulation. To the framework, cladding is attached, wherein the framework creates an air space between the exterior insulation and the cladding. The cladding is arranged such that the air space is ventilated to the outside air. Ventilated rain screen cladding systems partially dissipate heat from the sun because of the ventilated air space between the cladding and the exterior wall. The air space also serves to evacuate water and humidity that might have penetrated behind the cladding and serves to prevent condensation in the structural wall. Further, as the insulation is affixed exterior to the structural wall, the structural wall is protected from all but minor temperature variations.

The American Society of Heating, Refrigerating and Air-Conditioning Engineers, Inc. standard 90.1 is a standard that provides minimum requirements for energy efficient designs for buildings except for low-rise residential buildings. In order to attach a ventilated rain screen cladding systems to a building and be compliant with ASHRAE standard 90.1 regarding thermal breaks through the exterior foam insulation, only fasteners such as screws may traverse the exterior foam insulation.

Attachment systems of the prior art for ventilated rain screen systems where only fasteners traverse the exterior foam insulation are succeptible to compressing the exterior foam insulation, thereby reducing its insuating value. The exterior foam insulation employed is typically of an isocyanurate, styrofoam or similar type; typically, compressive force of 25 psi or greater is sought to be avoided so that crushing of these types of exterior foam insulations is reduced. In some of these prior art attachment systems, vertical load placed upon brackets attached by fasteners through the exterior foam insulation allows the brackets to be deflected downward causing the lower end of the bracket to make additional compressions at the lower end of the brackets. In other prior art attachment systems, the compression problems associated with the downward deflection of brackets is reduced by attaching long vertical members, typically of a c-channel configuration, with fasteners through the exterior foam insulation, to which brackets are then attached; This results in increased material costs and increased installation diffuculty.

Accordingly, objectives of the present invention are to provide a metal attachment system for ventilated rain screen cladding systems, that exceeds ASHRAE standard 90.1 regarding thermal breaks through exterior foam insulation, that prevents exterior foam insulation crushing, that is constructed on site of components of manageable size and minimal weight, that is of reduced cost, that is not sucseptible to insulation crushing through overtightening of fasteners, and that may also be utilized with lower density exterior insulation, such as mineral wool.

SUMMARY OF THE INVENTION

The present invention provides an attachment system for a ventilated rain screen cladding system that eliminates exterior foam insulation crushing. The attachment system is constructed by attaching anti-crush brackets with horizontal fasteners such as self tapping screws horizontally through horizontal apertures in the anti crush bracket which traverse the exterior foam insulation and are secured in the wall studs. The anti-crush bracket is fabricated from two plates that are secured to one another. The first plate which is in contact with the exterior foam insulation is flat to distribute any compressive load against the exterior foam insulation. The second plate is fabricated so that a cavity is created between the first and second plate when they are attached causing the anti-crush bracket to have increased rigidity. The anti-crush bracket is fabricated of such dimensions as necessary to accommodate the anticipated load to be placed upon the anti-crush bracket and the density of the external insulation employed. A threaded diagonal fastener is secured through a diagonal aperture in the lower portion of the anti-crush bracket where threads in the diagonal aperture engage the threads of the diagonal fastener. The diagonal fastener traverses the exterior foam insulation at an upward angle and is secured by threads on the diagonal fastener into the wall stud. Under vertical load any tendency of the anti-crush bracket to deflect downward is prevented with the load being absorbed as a compressive force on the diagonal fastener. Although not preferred, it should be recognized that the anti-crush fastener could be installed inverted where the force upon the diagonal fastener would be reversed.

A horizontal member is secured to horizontally adjacent anti-crush brackets by L-brackets. The horizontal member is typically L or U shaped in cross section. Cladding attachment members are secured in a vertical fashion along the horizontal members. The cladding attachment members may be spaced along the horizontal member to accommodate the size of the cladding pieces without regard to the spacing and placement of the wall studs. With the cladding in place the anti-crush brackets, the horizontal members and the cladding attachment members create a ventilation cavity between the exterior foam insulation and the cladding.

In a second embodiment of the invention where the width of the cladding is sized to conform to the spacing between the wall studs, the horizontal members are eliminated. This second embodiment of the attachment system is constructed by attaching anti-crush brackets with horizontal fasteners such as self tapping screws horizontally through horizontal apertures in the anti-crush bracket which traverse the exterior foam insulation and are secured in the wall studs. The anti-crush bracket is fabricated from two plates that are secured to one another. The first plate which is in contact with the exterior foam insulation is flat to distribute any compressive load against the exterior foam insulation. The second plate is fabricated so that a cavity is created between the first and second plate when they are attached causing the anti-crush bracket to have increased rigidity. The anti-crush bracket is fabricated of such dimensions as necessary to accommodate the anticipated load to be placed upon the anti-crush bracket and the density of the external insulation employed. A threaded diagonal fastener is secured through a diagonal aperture in the lower portion of the anti-crush bracket where threads in the diagonal aperture engage the threads of the diagonal fastener. The diagonal fastener traverses the exterior foam insulation at an upward angle and is secured by threads on the diagonal fastener into the wall stud. Under vertical load any tendency of the anti-crush bracket to be deflected downward is prevented with the load being absorbed as a compressive force on the diagonal fastener. Although not preferred, it should be recognized that the anti-crush fastener could be installed inverted where the force upon the diagonal fastener would be reversed.

Cladding attachment members are secured to vertically adjacent anti-crush bracket by L-brackets. The cladding attachment members in this second embodiment are typically L or T shaped in cross section. With the cladding in place the anti-crush brackets and the cladding attachment members create a ventilation cavity between the exterior foam insulation and the cladding.

In this second embodiment which eliminates the horizontal members of the first embodiment, there is less tendency for the anti-crush brackets to deflect downward, therefore a number of the anti-crush brackets may be replaced by a more economical attachment means to the wall stud. One such attachment means where an anti-crush bracket is replaced is to use threaded rods. A threaded rod is secured to a threaded aperture in the wall stud. The threaded rod traverses the external foam insulation, and an aperture in a flat dispersal plate which distributes any compressive load against the external foam insulation. The dispersal plate is secured against the external foam insulation by a nut engaged upon the threaded rod. The threaded rod finally is engaged within a threaded fixture secured to the cladding attachment member. The length of the threaded rod between the threaded aperture in the wall stud and the threaded fixture secured to the cladding attachment member may be adjusted so that the cladding surface can be installed plumb where the wall studs are out of plumb.

In the previously described embodiments, the incorporation of the diagonal fasteners decreases the vertical load on the horizontal fasteners allowing the use of smaller gauge horizontal fasteners thereby reducing thermal conductivity by these fasteners.

A first further improvement applicable to both the first and the second embodiment is to have the horizontal apertures threaded to correspond and engage the threads of the horizontal fasteners. In application, with the horizontal apertures threaded, compression of the external foam insulation by the anti-crush bracket through over tightening of the horizontal fasteners is eliminated as threads on the horizontal fastener engage threads in the anti-crush bracket and threads on the horizontal fastener engage the wall stud at the same rate and is stopped when the horizontal fastener's head contacts the periphery of the horizontal aperture's aperture. Additionally, where the horizontal apertures of the anti-crush bracket are threaded and engage the threads of the horizontal fasteners, the horizontal fasteners serve to retain the frame stud and anti-crush fastener at a fixed distance between them further preventing compression of the exterior foam insulation; it should be noted that compression due to wind loads is also thereby prevented.

A second further improvement applicable to the previously described embodiments is to have the horizontal fasteners and diagonal fasteners with threads at the head end of the shank of greater diameter than the threads at the point end of the shank. Such configuration allows more rapid installation as the point end of the shank can be advanced through the aperture in the anti-crush bracket without engaging the threads therein. Additionally, in this second improvement the fasteners may be fabricated with different advancing thread pitches at the head end and point end of the fastener so that, where advisable, a predetermined compressive force may be applied between the anti-crush bracket and the exterior insulation. Where the advancing thread pitch at the point end of the fastener is greater than the advancing thread pitch at the head end of the fastener, a predetermined compressive force is applied between the anti-crush bracket and the exterior insulation from installation of the fastener.

DETAILED DESCRIPTION OF THE DRAWINGS

Figure 1:
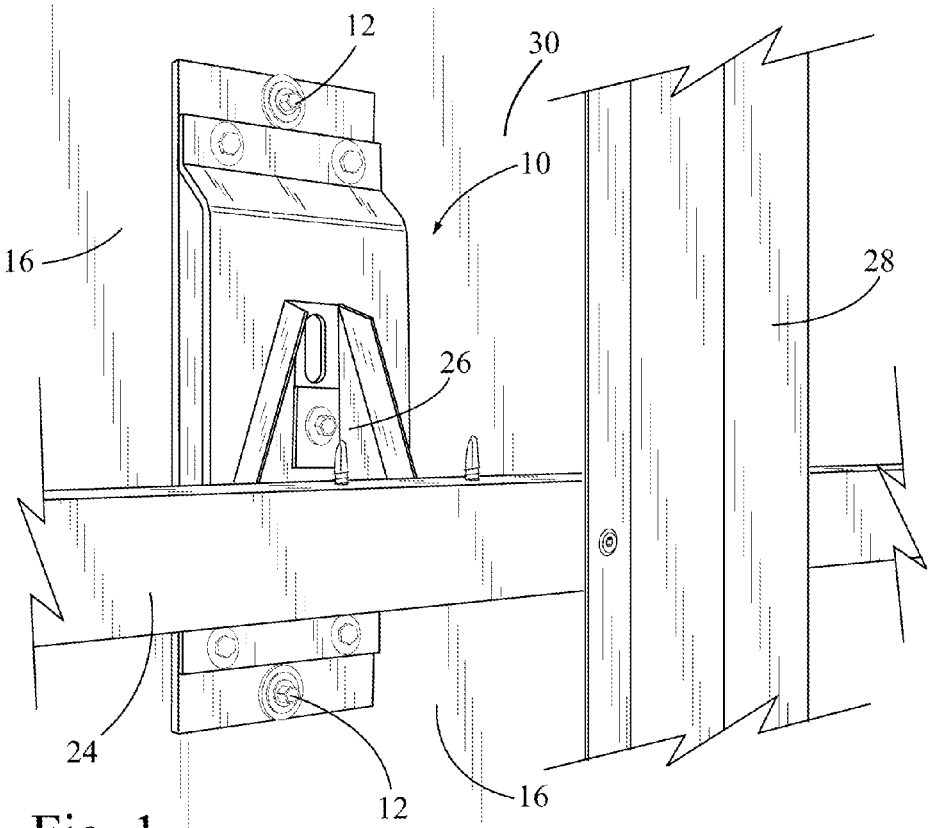
FIG. 1 is a partial perspective view of the attachment system of the first embodiment of the present invention.
Figure 2:
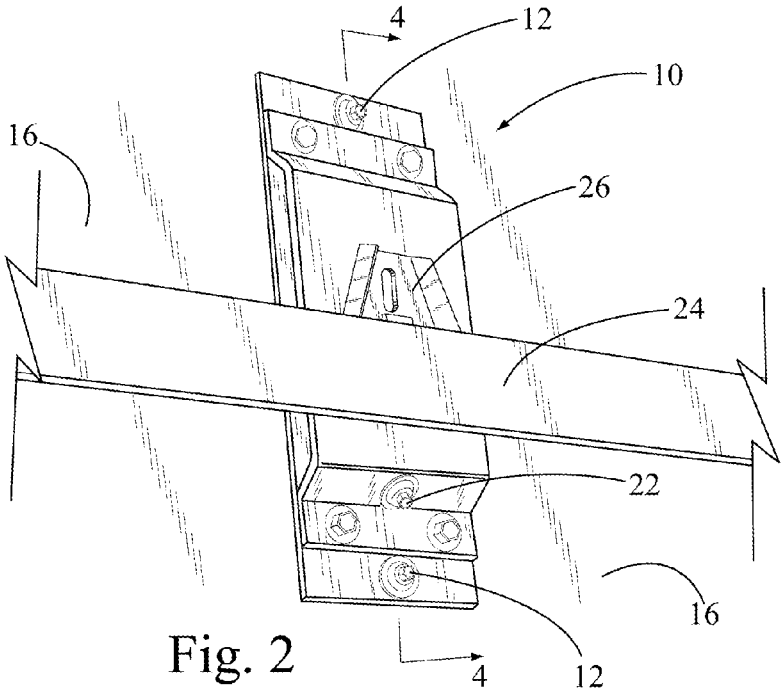
FIG. 2 is a partial perspective view of the attachment system of the first embodiment of the present invention.
Figure 3:
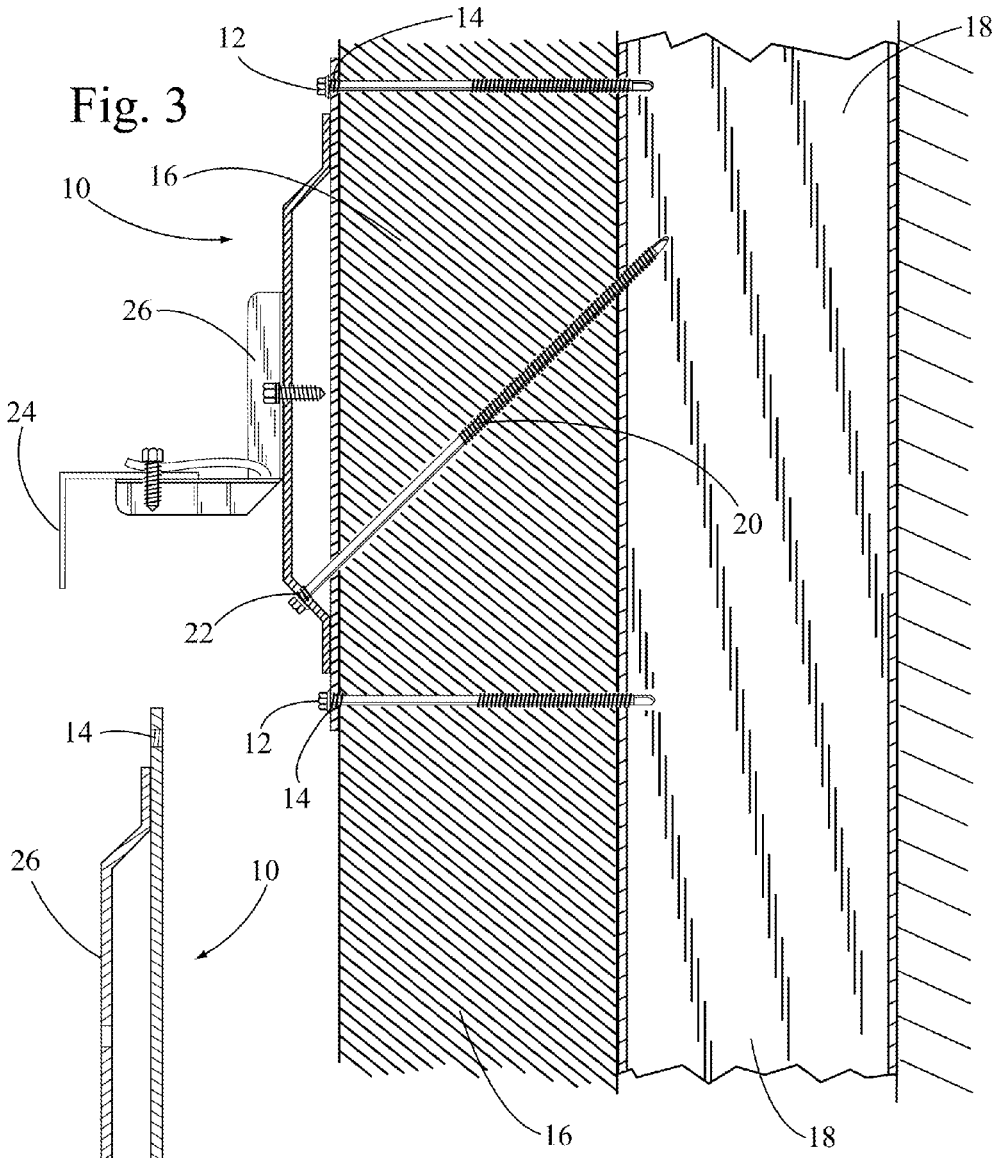
FIG. 3 is a sectional view through the attachment system of the first embodiment of the present invention and illustrates the threaded horizontal apertures of the anti-crush bracket described in the first further improvement applicable to the present invention; the illustration of the anti-crush bracket and its attachment to the wall stud is also applicable and illustrative to that of the second embodiment.
Figure 4:
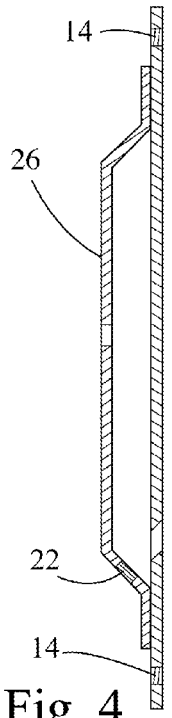
FIG. 4 is a sectional view through the anti-crush bracket utilized in both the first and second embodiments of the present invention and illustrates the threaded horizontal apertures of the anti-crush bracket described in the first further improvement applicable to the present invention.
Figure 5:
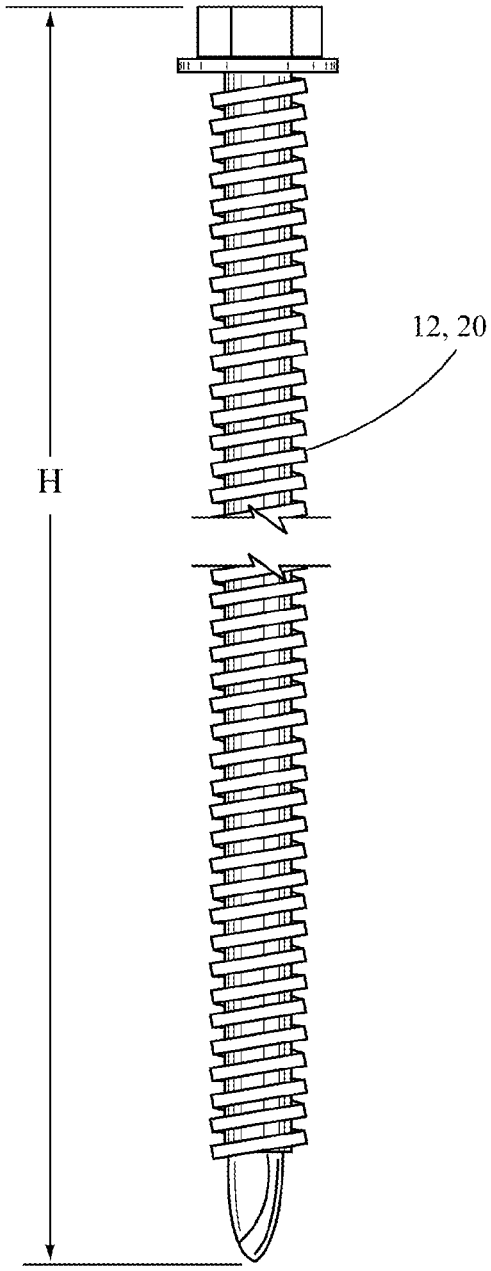
FIG. 5 is a perspective view of a horizontal fastener or diagonal fastener utilized in the first embodiment and second embodiment of the present invention.

Referring to FIGS. 1, 2, 3, 4 and 9, in the first embodiment of the present invention, the metal attachment system for a ventilated rain screen cladding system is constructed by attaching anti-crush brackets 10 with horizontal fasteners 12 such as self tapping screws horizontally through horizontal apertures 14 in the anti crush bracket 10. The horizontal fasteners traverse the exterior foam insulation 16 and are secured by threads on horizontal fasteners 12 in the wall studs 18. The anti-crush bracket 10 is fabricated from two plates that are secured to one another. The first plate which is in contact with the exterior foam insulation 16 is flat and the second plate is fabricated so that a cavity is created between the first and second plate when they are attached causing the anti-crush bracket to have increased rigidity. A threaded diagonal fastener 20 is secured through a threaded diagonal aperture 22 in the lower portion of the anti-crush bracket 10. The diagonal fastener 20 traverses the exterior foam insulation at an upward angle and is secured by threads on diagonal fastener 20 into the wall stud 18. A horizontal member 24 is secured to horizontally adjacent anti-crush brackets 10 by L-brackets 26. Cladding attachment members 28 are secured in a vertical fashion along the horizontal members 24. The cladding attachment members are spaced along the horizontal member to accommodate the size of the cladding pieces without regard to the spacing and placement of the wall studs 18. With the cladding in place the anti-crush brackets 10, the horizontal members 24 and the cladding attachment members 28 create a ventilation cavity 30 between the exterior foam insulation 16 and the cladding.

Referring to FIGS. 3, 4, 5, 7 and 8, in the second embodiment of the present invention, the metal attachment system for a ventilated rain screen cladding system is constructed by attaching anti-crush brackets 10 with horizontal fasteners 12 such as self tapping screws horizontally through horizontal apertures 14 in the anti-crush bracket 10. The horizontal fasteners traverse the exterior foam insulation 16 and are secured by threads on horizontal fasteners 12 into the wall studs 18. The anti-crush bracket 10 is fabricated from two plates that are secured to one another. The first plate which is in contact with the exterior foam insulation 16 is flat and the second plate is fabricated so that a cavity is created between the first and second plate when they are attached causing the anti-crush bracket to have increased rigidity. A threaded diagonal fastener 20 is secured through a threaded diagonal aperture 22 in the lower portion of the anti-crush bracket 10 where threads in the threaded diagonal aperture 22 engage the threads of the diagonal fastener 20. The threaded diagonal fastener 20 traverses the exterior foam insulation 16 at an upward angle and is secured by threads on diagonal fastener 20 into the wall stud 18. Cladding attachment members 28 are secured to vertically adjacent anti-crush brackets 10 by L-brackets 32. With the cladding in place the anti-crush brackets 10 and the cladding attachment members 28 create a ventilation cavity 30 between the exterior foam insulation 16 and the cladding.

In this second embodiment where some anti-crush brackets 10 are replaced by a more economical attachment means to the wall stud 18, a threaded rod 34 is secured to a threaded aperture 36 in the wall stud 18. The threaded rod 34 traverses the external foam insulation 16, and an aperture in a flat dispersal plate 38. The dispersal plate 38 is secured against the external foam insulation 16 by a nut 40 engaged upon the threaded rod 34. The threaded rod 34 finally is engaged within a threaded fixture 42 secured to the cladding attachment member 28. The distance of threaded rod 34 between threaded aperture 36 and threaded fixture 42 may be adjusted to plumb the cladding surface where it would otherwise result in an out of plumb surface.

Referring to FIGS. 3, 4, 5 and 6 applicable to the first and second embodiments, a first further improvement is illustrated where threads near the head end of horizontal fasteners 12 engage threads within horizontal apertures 14 in anti-crush bracket 10 and threads near the point end of horizontal fasteners 12 engage and are secured to wall studs 18, such that the threads near the head end of a horizontal faster 12 advances through the horizontal aperture 14 at the same rate as the threads near the point end of horizontal fastener 12 engage the wall stud 18, thereby maintaining the distance between anti-crush bracket 10 and wall stud 18.

Figure 6:
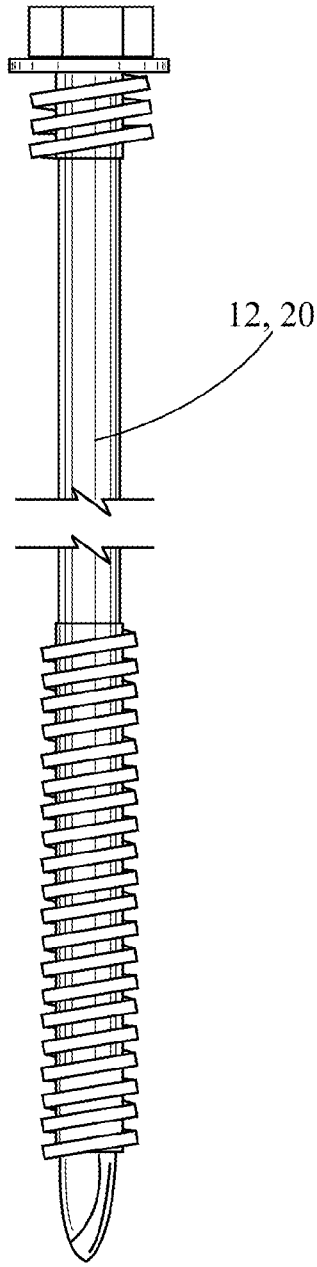
FIG. 6 is a perspective view a horizontal fastener or diagonal fastener utilized in the first embodiment and second embodiment of the present invention and illustrates the greater diameter threads at the head end of the fastener than at the point end of the fastener as described in the second further improvement applicable to the present invention.
Figure 7:
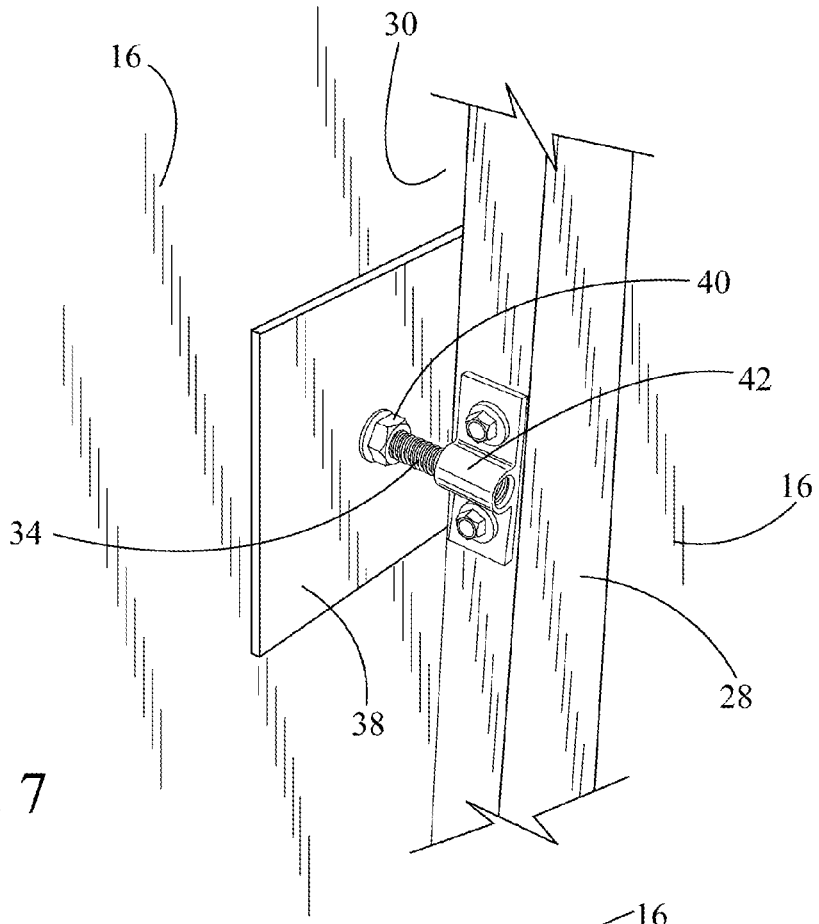
FIG. 7 is a perspective view of an alternative attachment means that may be utilized to replace one or more of the anti-crush brackets in the second embodiment.
Figure 8:
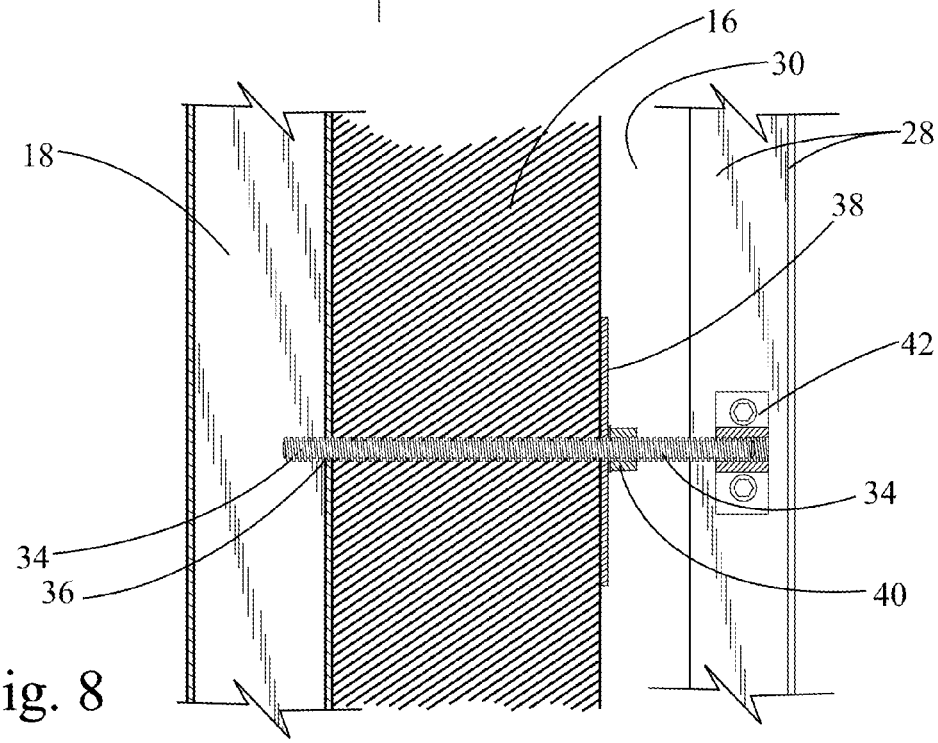
FIG. 8 is a sectional view of an alternative attachment means that may be utilized to replace one or more of the anti-crush brackets in the second embodiment.
Figure 9:
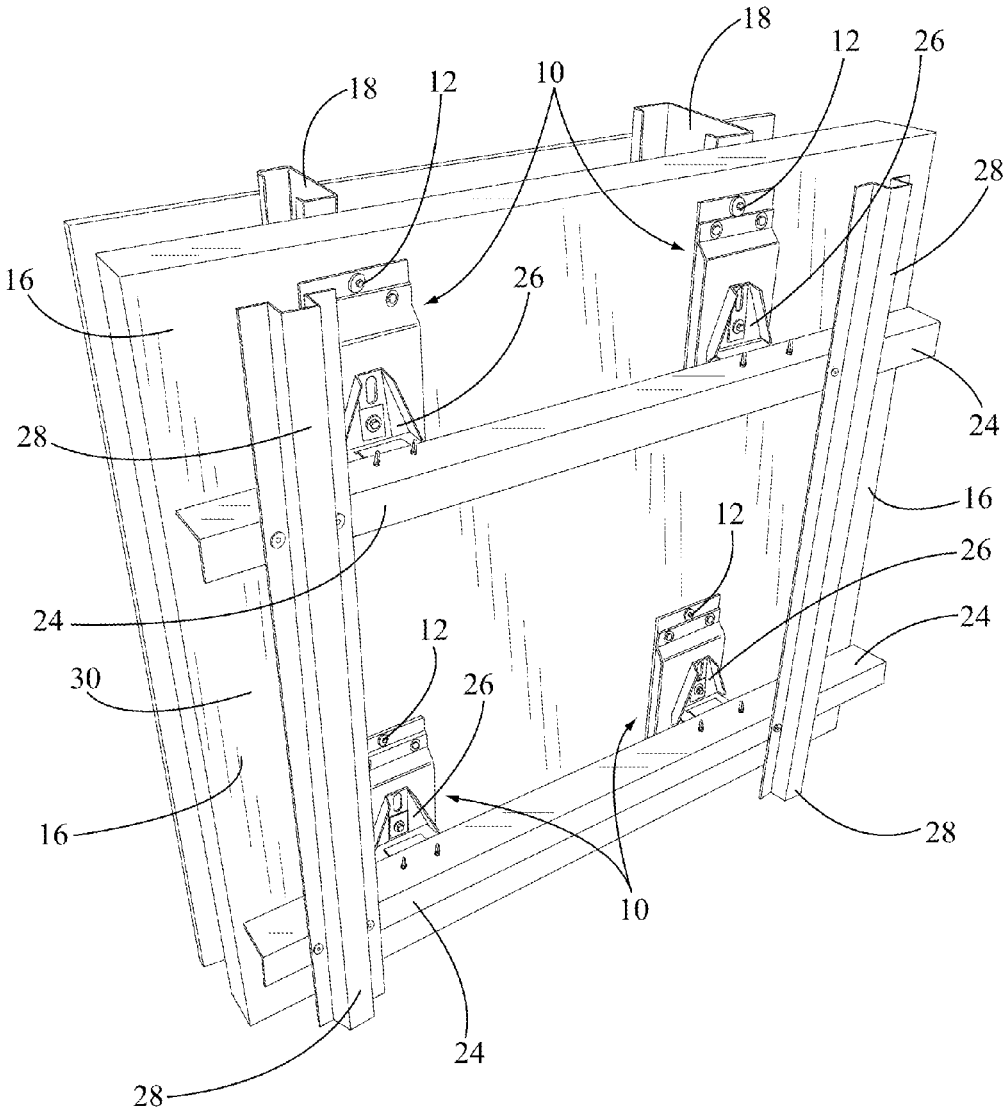
FIG. 9 is a perspective view of a partial wall segment illustrating the attachment system of the first embodiment of the present invention.

FIG. 6 illustrates a configuration for horizontal fasteners 12 and threaded diagonal fasteners 20 where the diameter of the threads near the head end of horizontal fasteners 12 and threaded diagonal fasteners 20 is greater than the diameter of the threads near the point end of horizontal fasteners 12 and threaded diagonal fasteners 20.

Although the detailed description of the drawings is directed toward illustrating the above described preferred embodiments, the present invention is not limited to such embodiments, as variations and modifications may be made without departing from the scope of the present invention.

We claim:

1. A system for attaching cladding to the exterior of a structure that has insulation installed upon the exterior of its structural walls comprising:

a number of anti-crush brackets, each said anti-crush bracket having a front face and a rear face, said number of anti-crush brackets being installed in a spaced vertical and horizontal array where said rear face of each said anti-crush bracket is in contact with the exterior face of insulation installed upon the exterior of the structural walls, a framework for attachment of cladding is provided where horizontal members are secured to said front face of horizontally adjacent anti-crush brackets, and cladding attachment members in spaced arrangement are secured upon vertically adjacent horizontal members, said cladding is attached to said cladding attachment members creating a ventilation cavity between said cladding and said insulation installed upon the exterior of the structural walls, each said anti-crush bracket is attached with at least one horizontal fastener, said fastener having threads along its shank, said horizontal fastener extending horizontally through a horizontal aperture in said anti-crush bracket, traversing the insulation and secured by said threads to a stud of said structural wall, each said anti crush-bracket is further attached with at least one diagonal fastener, said diagonal fastener having a head end and a point end and having threads along its shank, said diagonal fastener extending through a diagonal threaded aperture in said anti-crush bracket traversing the insulation and secured by said threads to a stud of said structural wall, threads of said diagonal threaded aperture correspond to and engage said threads near said head end of said diagonal fastener.

2. A system for attaching cladding to the exterior of a structure that has insulation installed upon the exterior of its structural walls comprising:

a number of anti-crush brackets, each said anti-crush bracket having a front face and a rear face, said number of anti-crush brackets being installed in a spaced vertical and horizontal array where said rear face of each said anti-crush bracket is in contact with the exterior face of insulation installed upon the exterior of the structural walls, a framework for attachment of cladding is provided where cladding attachment members are secured upon vertically adjacent anti-crush brackets, said cladding is attached to said cladding attachment members creating a ventilation cavity between said cladding and said insulation installed upon the exterior of the structural walls, each said anti-crush bracket is attached with at least one horizontal fastener, said fastener having threads along its shank, said horizontal fastener extending horizontally through a horizontal aperture in said anti-crush bracket, traversing the insulation and secured by said threads to a stud of said structural wall, each said anti crush-bracket is further attached with at least one diagonal fastener, said diagonal fastener having a head end and a point end and having threads along its shank, said diagonal fastener extending through a diagonal threaded aperture in said anti-crush bracket traversing the insulation and secured by said threads to a stud of said structural wall, threads of said diagonal threaded aperture correspond to and engage said threads near said head end of said diagonal fastener.

3. The system for attaching cladding to the exterior of a structure that has insulation installed upon the exterior of its structural walls according to claim 1 or 2 wherein:

said horizontal fastener having a head end and a point end, said horizontal aperture in said anti-crush bracket having threads, said threads of said horizontal aperture corresponding to and engaging said threads near said head end of said horizontal fastener.

4. The system for attaching cladding to the exterior of a structure that has insulation installed upon the exterior of its structural walls according to claim 3 wherein:

the diameter of the thread near the point end of said horizontal fastener is smaller than the threads near the head end of the horizontal fastener, and the diameter of the threads near the point end of said diagonal fastener is smaller than the threads near the head end of said diagonal fastener.

5. The system for attaching cladding to the exterior of a structure that has insulation installed upon the exterior of its structural walls according to claim 4 wherein:

the advancing pitch of said threads near the point end of said horizontal fastener is greater than the advancing pitch of said threads near the head end of said horizontal fastener.

6. The system for attaching cladding to the exterior of a structure that has insulation installed upon the exterior of its structural walls according to claim 2 wherein:

some of said anti-crush brackets are replaced by a flat dispersal plate, said flat dispersal plate having a front face and a rear face with said rear face of said flat dispersal plate is in contact with said exterior face of said insulation installed upon said exterior of said structural walls, a threaded rod having a first end and a second end is placed through an aperture in said flat dispersal plate with its first end traversing said insulation and engaging a threaded aperture in said wall stud, a nut upon said threaded aperture is secured against said front face of said flat dispersal plate and the second end of said threaded rod is secured by a threaded fixture attached to said cladding attachment member.

* * * * *